US006808030B2

(12) United States Patent
Klemm

(10) Patent No.: US 6,808,030 B2
(45) Date of Patent: Oct. 26, 2004

(54) ENLARGEMENT DRILLING SYSTEM

(76) Inventor: Günter W. Klemm, Gray 21, A-9572, Deutsch-Griffen (AT)

( * ) Notice: Subject to any disclaimer, the term of this patent is extended or adjusted under 35 U.S.C. 154(b) by 20 days.

(21) Appl. No.: 10/252,727

(22) Filed: Sep. 23, 2002

(65) Prior Publication Data

US 2003/0066684 A1 Apr. 10, 2003

(30) Foreign Application Priority Data

Oct. 8, 2001 (EP) ..... 01123939

(51) Int. Cl.[7] ..... E21B 7/28
(52) U.S. Cl. ..... 175/53; 175/407; 405/184
(58) Field of Search ..... 175/53, 296, 61, 175/75, 298, 407; 405/139, 184, 184.1

(56) References Cited

U.S. PATENT DOCUMENTS

| | | | | | |
|---|---|---|---|---|---|
| 2,018,007 | A | | 10/1935 | Brewster | |
| 2,315,629 | A | | 4/1943 | Le Bus | |
| 2,684,581 | A | | 7/1954 | Zublin | |
| 3,797,586 | A | | 3/1974 | Coyne et al. | |
| 3,894,402 | A | * | 7/1975 | Cherrington | 405/184 |
| 3,905,431 | A | * | 9/1975 | Hasewend | 175/53 |
| 4,043,136 | A | * | 8/1977 | Cherrington | 405/161 |
| 4,362,520 | A | | 12/1982 | Perry | |
| 4,368,786 | A | | 1/1983 | Cousins | |
| 4,442,908 | A | | 4/1984 | Steenbock | |
| 4,476,945 | A | | 10/1984 | Hearn | |
| RE32,267 | E | * | 10/1986 | Cherrington | 175/53 |
| 4,732,223 | A | | 3/1988 | Schoeffler et al. | |
| 4,787,463 | A | | 11/1988 | Geller et al. | |
| 4,878,547 | A | * | 11/1989 | Lennon | 175/53 |
| 4,880,067 | A | | 11/1989 | Jelsma | |
| 5,007,487 | A | | 4/1991 | Dahle et al. | |
| 5,078,218 | A | | 1/1992 | Smet | |
| 5,238,073 | A | * | 8/1993 | Rear | 175/53 |
| 5,265,687 | A | | 11/1993 | Gray | |
| 5,375,669 | A | * | 12/1994 | Cherrington | 175/53 |
| 5,467,834 | A | | 11/1995 | Hughes et al. | |
| 5,538,092 | A | | 7/1996 | Precopia | |
| 5,542,482 | A | | 8/1996 | Eddison | |
| 5,547,031 | A | | 8/1996 | Warren et al. | |
| 5,791,419 | A | * | 8/1998 | Valisalo | 175/53 |
| 5,937,954 | A | | 8/1999 | Puttmann et al. | |
| 5,961,252 | A | * | 10/1999 | Mercer et al. | 405/175 |
| 6,012,536 | A | | 1/2000 | Puttmann et al. | |

(List continued on next page.)

FOREIGN PATENT DOCUMENTS

| | | | | |
|---|---|---|---|---|
| DE | 42 11 081 | | 9/1993 | |
| DE | 42 25 701 | C1 | 12/1993 | |
| DE | 43 28 278 | | 3/1994 | |
| DE | 196 12 902 | | 10/1997 | |
| DE | 199 46 587 | A1 | 4/2001 | |
| DE | 19946587 | A1 * | 4/2001 | E21B/7/18 |
| EP | 0 387 218 | | 2/1990 | |
| EP | 411278 | A1 * | 2/1991 | E03F/3/06 |
| EP | 0 763 648 | A1 | 3/1997 | |

OTHER PUBLICATIONS

European Search Report, EP 01 12 3939, Mar. 14, 2002.

*Primary Examiner*—David Bagnell
*Assistant Examiner*—Daniel Stephenson
(74) *Attorney, Agent, or Firm*—Meyertons Hood Kivlin Kowert & Goetzel, P.C.; Jeffery C. Hood

(57) ABSTRACT

The invention concerns a drilling apparatus for enlarging a bore in the ground, comprising a drilling head (6) having a drilling bit (12); a percussion piston (14) which is driven by a drive medium (9) and which impacts against the drilling bit (12), and a hollow drill string (8) to which the drilling head (6) is fixed and through the cavity of which the drive medium (9) is passed to the percussion piston (14). The drill string (8) is surrounded by a hollow outer string (3) enclosing an annular space which surrounds the drill string (8) and through which the drive medium (9) is passed out of the borehole. The invention further concerns a method of enlarging an existing borehole, using a drilling head of that kind.

55 Claims, 4 Drawing Sheets

U.S. PATENT DOCUMENTS 6,109,828 A * 8/2000 Keller ..... 405/146
6,109,832 A * 8/2000 Lincoln ..... 405/184
6,244,783 B1 * 6/2001 Puttmann et al. ..... 405/184
6,454,025 B1 * 9/2002 Runquist et al. ..... 175/61
6,516,902 B1 * 2/2003 Klemm ..... 175/296
6,527,067 B1 3/2003 Ravensbergen et al.
6,659,198 B2 * 12/2003 Camp ..... 175/53
2001/0006120 A1 7/2001 Miyamoto et al.

* cited by examiner

ENLARGEMENT DRILLING SYSTEM

FIELD OF THE INVENTION

The invention concerns a drilling apparatus for enlarging a borehole in the ground. The drilling apparatus includes a drilling head which has a drilling bit, a percussion piston which is driven by a drive medium and impacts against the drilling bit, and a hollow drill string to which the drilling head is fixed and through the cavity of which the drive medium is passed to the percussion piston.

The invention further concerns a method of enlarging an existing borehole, in which a drilling head is fixed to a hollow drill string introduced into the borehole and is drawn through the borehole, wherein a percussion piston which is driven by a drive medium which is fed through the hollow drill string impacts on a drilling bit of the drilling head during the drilling operation.

DESCRIPTION OF THE RELATED ART

A drilling apparatus of that kind which operates in accordance with the specified method is described in U.S. Pat. No 5,791,419. The drilling apparatus described therein serves for drilling out an existing pipe in the ground and for replacing that pipe by a fresh pipe. The hollow drill string is firstly pushed through the pipe which is to be drilled out. When it issues at the end of the pipe to be drilled out the drilling head is fixed to the hollow drill string. The drilling crown or annular drilling arrangement, that is to say the surface of the drilling head which is fitted with the cutting edges or teeth and which provides for removal of the drilling waste material, faces in that situation towards the drill string. A percussion piston within the drill head which is of an annular configuration and surrounds the drill string can apply hammer blows to the rear of a drill bit which carries the annular drilling arrangement. The drill bit is axially movably fixed to the drilling head by way of a damping element.

The drive medium for actuation of the percussion piston—usually compressed air—is passed through the interior of the hollow drill string to the drilling head and to the percussion piston. After flowing through the passages in the drilling head and driving the percussion piston the drive medium flows through a passage to the annular drilling arrangement of the drilling bit. From here it can flow in the pipe to be renovated in parallel relationship with the drill string back again towards the opening of the pipe to be drilled out.

This return flow of the drive medium which possibly blows the drilling waste material out of the borehole is effected in the annular space around the drill string which is guided at a large radial spacing relative to the pipe to be renewed. In order to provide for drilling out the pipe in substantially parallel relationship with its axis that drilling head must have a guide body and centering body. If the drill string is guided through a blocked region or a water-filled region of the pipe to be renewed, there is the danger that the return flow of the drive medium is impeded or interrupted.

SUMMARY OF THE INVENTION

One object of the invention is to develop a method and an apparatus for enlargement drilling of the specified kind, in such a way as to ensure that the drive medium is blown out without disturbance.

In regard to one embodiment of the drilling apparatus that object is attained in that the drill string is surrounded by a hollow outer string which encloses an annular space which surrounds the drill string and through which the drive medium is passed out of the borehole.

In accordance with the apparatus of the invention according to one embodiment, an annular second passage within a string in the form of a double string affords a passage which is separate from the surroundings in the borehole and through which the drive medium which is guided into the borehole can flow after driving the percussion piston in order to be passed out of the borehole. It is possible in that way to prevent materials from the ground around the string from being flushed out of the borehole together with the drive medium. For example if the borehole extends below the ground water table the amount of water which is blown out of the borehole jointly with the drive medium is reduced by the outer drill string through which the drive medium flows back.

The method according to one embodiment of the invention is preferably used for enlarging a pilot bore which was produced in a directional drilling process. In the case of directional drilling a support pipe is generally drawn into the borehole behind a steerable directional drilling head. At the same time a support medium is supplied, which usually comprises bentonite mixed with water. In that case the support pipe which is drawn in during the production of a pilot bore with the directional drilling head is preferably used as an outer string of the enlargement drilling apparatus. That support pipe is surrounded flush by the borehole. The aqueous bentonite which surrounds the support pipe is of a jelly-like consistency which permits axial movement of the support pipe with a very low level of frictional resistance. It will be noted however that it closes an annular space outside the string, through which the drive medium could flow out. The outer string of the drilling apparatus according to one embodiment of the invention ensures that the support medium is not undesirably blown out of the borehole by the drive medium for the percussion hammer. The drive medium can flow freely jointly with the drilling waste material through the annular space between the inner drill string and the outer string towards the end of the borehole.

As, unlike the situation with conventional drilling processes, the drill string applies a pulling force to the drilling head in the enlargement drilling procedure, the drill string preferably projects through the drilling head and is connected to the rear thereof. The percussion piston is preferably of an annular configuration, surrounds the drill string and impacts against the rear of the drill bit of the drilling head.

The annular drilling arrangement, that is to say the surface which provides for removal of the ground, is arranged at the side of the drilling head, that is remote from the end of the drill string.

The drive medium is thus guided through the inner drill string which extends through the drilling head. Screwed on the end of the inner drill string is a closure cover which seals off the interior of the drill string and applies the pulling force from the drill string to the drilling head. The drilling head is of a substantially cylindrical shape. A sleeve-shaped piston is displaceably guided in the drilling head. Passages for the flow of the drive medium into the annular region in which the percussion piston is accommodated also extend in the drilling head and in the closure cover. The drive medium flows through preferably pneumatic control means which cause the piston movement and which have been known for years in connection with pneumatic deep hole drilling hammers. The impact surface of the drilling bit is disposed at the end of the flow path for the drive medium and at the end of the space for movement of the percussion piston. A passage for the flow of the drive medium also passes through the drilling bit and opens in the region of the annular drilling arrangement. In that way the drive medium is firstly passed through the inner drill string and then through the drilling head to the surface of the annular drilling arrangement, which provides for the removal of material. Disposed in front of the annular drilling arrangement in the pulling direction is at least one entry opening in the outer string, through which the drive medium which has been passed into the bottom of the enlargement bore can pass. The above-mentioned drive medium will thus flow by virtue of the increased pressure jointly with the removed material (drilling waste material) into the annular space between the outer string and the inner drill string and is transported through that annular space out of the borehole.

Preferably a rotary movement is transmitted to the annular drilling arrangement by way of the drill string. Usually, a string which is composed of individual string segments is used when producing a borehole in the ground which is at least 10 m and often over 100 m in length. In that case the inner drill string and the outer string are preferably screwed together by way of interengaging female and male screwthreads. As the vibrations caused by the percussion piston generally loosen a screw connection of that kind, a rotary drive in the screwing direction is utilized in order to prevent unwanted unscrewing and loosening of the drill string. Obviously and in particular the rotary movement which is transmitted by way of the drill string increases the material-removal capacity of the annular drilling arrangement.

Particularly preferably, the inner string and the outer string are fixed to a common coupling element outside the borehole. On the one hand the rotary movement is transmitted by way of the coupling element jointly to the inner drill string and to the outer string. On the other hand the drive medium is introduced by way of the coupling element into the interior of the inner drill string. The coupling element also has outlet openings for the drive medium which flows out of the borehole. The coupling element is preferably arranged on a forward drive machine having a linear drive which transmits the pulling force to the coupling element and by way of the coupling element to the inner drill string and the outer string.

The rotary force can be transmitted to the annular drilling arrangement either solely by the inner string or solely by the outer string or by both strings, at the same time.

As in the state of the art, the drill bit with the annular drilling arrangement is damped elastically with respect to the drill string. That reduces transmission of the percussion forces of the percussion piston from the drilling bit to the drill string. Thus the substantial part of the energy of the percussion piston for material removal is applied by way of the drilling bit to the end face of the annular drilling arrangement. Only a small proportion of that energy is transmitted to the drill string so that the latter is not overloaded.

Preferably a connecting element to which a support pipe is fixed is mounted at the end of the drilling head which is the rear end in the pulling direction. As already mentioned the drilling apparatus according to one embodiment of the invention is preferably used for enlargement drilling of pilot bores produced by a directional drilling process. The support pipe of the first enlargement bore which in many cases already forms the definitive service pipe which is drawn into the bore (for example for carrying fresh water, cables etc) prevents the bore produced from collapsing behind the drilling head. The support pipe is preferably drawn linearly through the borehole without a rotary movement and for that reason is decoupled from the rotary movement of the drill string.

The end of the support pipe which is drawn through the borehole is preferably closed by way of a head plate which is a component part of the connecting element. Preferably the head plate has at least one outlet passage for a support medium which is introduced through the support pipe into the borehole near the drilling head. As already mentioned, preferably bentonite mixed with water is used as the support medium, being of a gel-like consistency and involving a low level of frictional resistance so that the operation of drawing in the support pipe is made easier.

The surface of the head plate of the support pipe, which faces towards the drill string, preferably has at least in the outer region of its periphery a surface which extends inclinedly with respect to the radial direction of the drill string and which extends in a pointed configuration in the pulling direction. The preferably conical surface of the head plate provides for displacement of the drilling mud into the peripheral regions of the support pipe.

As mentioned above the novel drilling apparatus can carry out a method according to one embodiment of the invention for the enlargement of an existing borehole, in which a drilling head is fixed to a hollow drill string introduced into the borehole and is drawn through the borehole, wherein a percussion piston which is driven by a drive medium which is fed through the hollow drill string impacts against a drilling bit of the drilling head during the drilling procedure.

In accordance with one embodiment of the invention and to attain the above-specified object an outer string surrounding the drill string is drawn jointly therewith through the borehole, wherein enclosed between the outer string and the drill string is an annular space through which the drive medium is passed out of the borehole.

The method according to one embodiment of the invention is particularly preferably used for enlarging pilot bores which were produced by a directional drilling process. In the directional drilling process a steerable directional drilling head is driven through the ground. The directional drilling head is so designed that it produced a borehole whose longitudinal axis is curved in a given direction. The direction of the curvature can be varied by rotating the directional drilling head. If drilling is to be effected straight, the directional drilling head is rotated continuously about its longitudinal axis so that the curvature of the borehole is uniformly distributed in all directions and is thus cancelled out. In accordance with the state of the art a directional drilling head is pushed with a directional drill string through the borehole, wherein a support medium is introduced into the borehole, which bears flush against the directional drill string. After completion of the pilot bore that directional drill string forms the outer string for the drilling apparatus according to the invention.

In accordance with a hitherto unpublished European application to the present applicant with the application No 01 201 167.2, in directional drilling, with a percussion drill string introduced in the directional drill string, percussion forces can be transmitted to the directional drilling head. It will be appreciated that this percussion string is to be driven out of the outer string before introduction of the inner drill string. The percussion string in accordance with the above-identified European patent application comprises string segments which bear against each other and which are not screwed to each other. The string segments can be driven out for example through one end of the outer string, by a compressed air source being connected to the other end of the outer string.

As mentioned, a support pipe is preferably fixed to the side of the drilling head, which is opposite to the drill string, the support pipe being drawn jointly with the drilling head through the enlarged borehole. The above-mentioned support medium can be passed into the borehole through that support pipe.

As mentioned the drilling performance is preferably increased by using a rotary drive coupled to the drilling head. In that case the support pipe is preferably decoupled from the rotary movement of the drill string.

BRIEF DESCRIPTION OF THE DRAWINGS

An embodiment of the drilling apparatus according to the invention is described hereinafter with reference to the accompanying drawings in which.

DETAILED DESCRIPTION OF THE EMBODIMENTS

Figure 1:
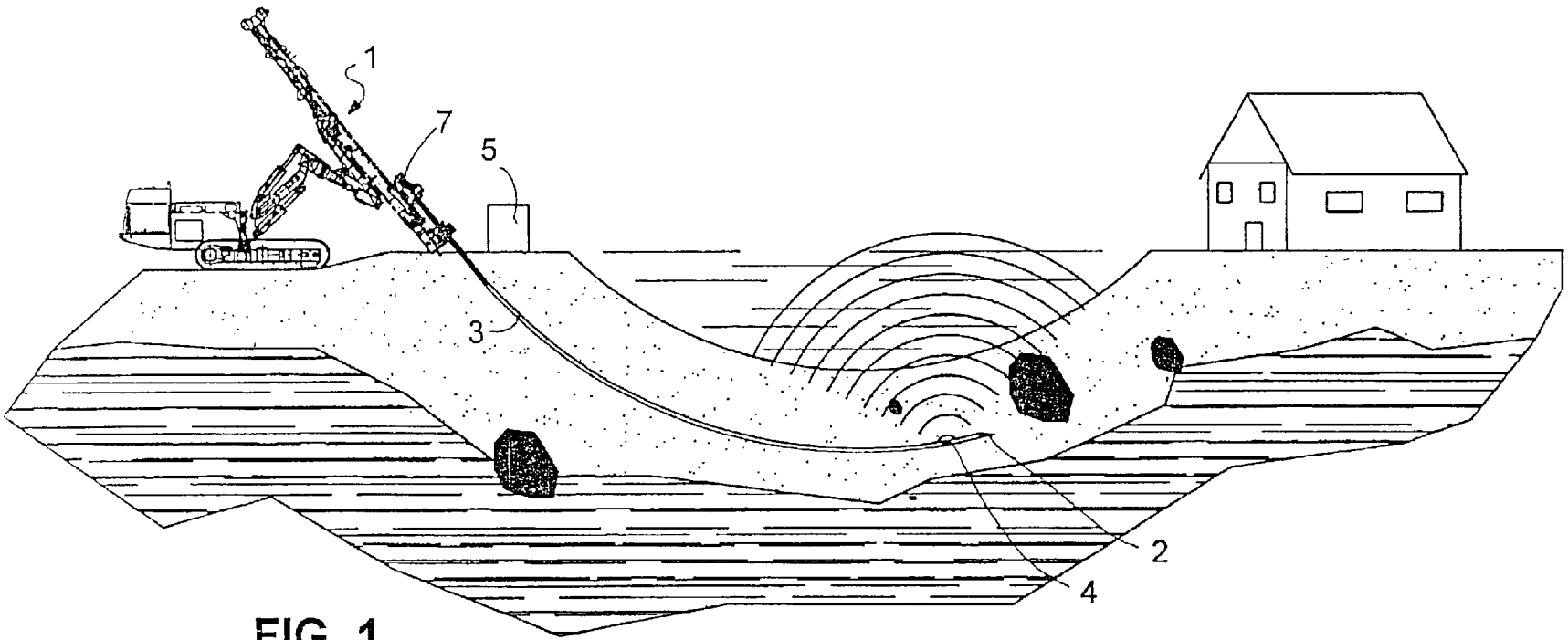
FIG. 1 is a diagrammatic view of an apparatus for carrying out directional drilling.

Referring to FIG. 1 the mode of operation involved in directional drilling can be seen therein. Using a forward drive machine 1, to produce a pilot bore a directional drilling head 2 is driven into the ground at an angle by means of a directional drill string 3. The directional drill string 3 is carried on a rail-guided sliding carriage of the forward drive machine 1 and is driven into the ground by a linear drive. After a forward drive movement by a given distance, a fresh section of the directional drill string 3 is attached thereto and the sliding carriage is withdrawn in order further to advance the directional drill string 3 which has been increased in length.

Arranged in the proximity of the directional drilling head 2 is a usually magnetic probe 4 which makes it possible to ascertain the respective precise position of the directional drilling head 2 by way of a navigation system and a monitor unit. The forward drive machine 1 also has a rotary drive 7 with which the directional drill string 3 can be rotated about its longitudinal axis and arrested in a given angular position. In that way the plane of the radius of curvature of the borehole produced can be inclined in any desired directions. The pilot borehole can thus be guided substantially parallel to the surface of the earth in any directions. In particular, as can be seen from FIG. 1, the bore can be guided with a large radius of curvature from an entry opening into the ground as far as an exit opening so that it is possible to overcome obstacles such as buildings, bodies of water or traffic areas, without an open timbering or lining. If straight borehole sections are to be produced the directional drilling head 2 is rotated uniformly about its axis.

A pump and mixing unit 5 for a flushing medium, also referred to as drilling mud, which comprises a mixture of bentonite and water, is connected to the drill string 3. The drilling mud is passed into the directional drill string 3 under high pressure and issues from flushing nozzles in the directional drilling head 2. That causes material to be removed in the region of the directional drilling head 2. The bentonite in the drilling mud then passes into the annular gap between the directional drill string 3 and the borehole. That on the one hand supports the borehole which has been produced and on the other hand produces a quite low-friction sliding film which reduces the resistance to the forward movement of the directional drill string 3.

The substantial proportion of the material removed during the directional drilling operation is effected by the flushing medium issuing from the flushing nozzles of the directional drilling head 2. Particularly in relatively hard rock the amount of material removed is increased by hammer or percussion forces applied to the directional drilling head 2 and possibly continuous rapid rotary movements. A directional drilling head 2 with integrated percussion hammer is known for example from DE 199 46 587 A1. The above-mentioned unpublished European patent application bearing the application No 01 201 167.2 shows a directional drilling head 2 in which the directional drill string 3 is hollow and guides a percussion string by way of which hammer blows can be transmitted from an outer percussion mechanism on to the directional drilling head 2.

Figure 4:
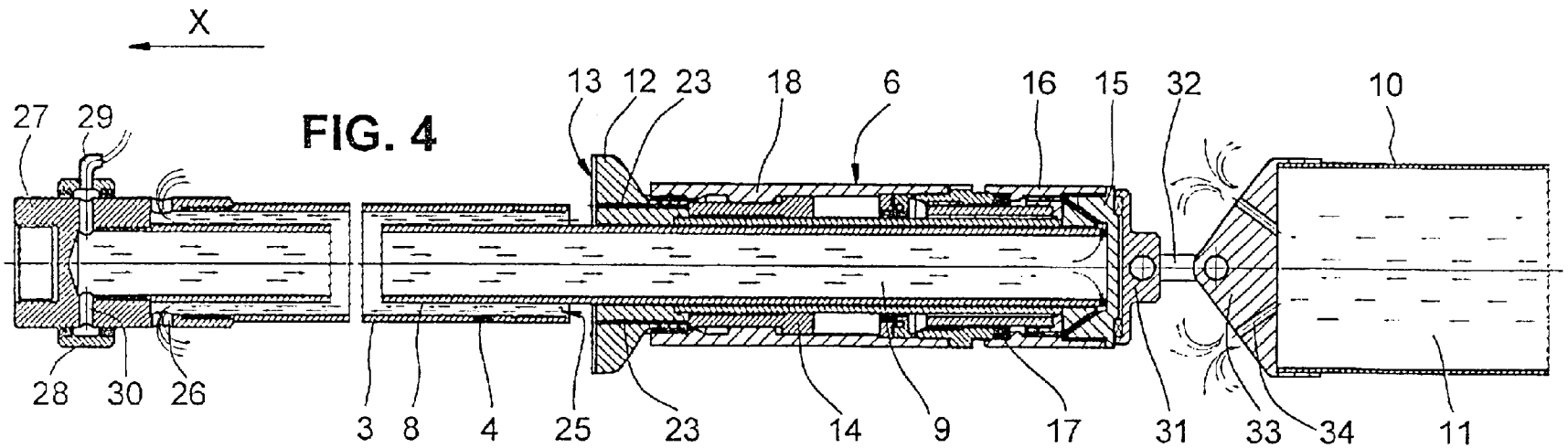
FIG. 4 is a view of the drilling head of FIG. 3, showing the flow direction of the various media.

After the pilot bore is finished the directional drilling head 2 which has issued from the exit opening of the borehole is removed from the directional drill string 3. An enlargement drilling head 6 according to one embodiment of the invention—hereinafter only referred to as the drilling head—can then be fixed to the hollow directional drill string 3 in accordance with the above-specified European patent application, which is then drawn through the pilot bore. In that case the linear drive of the forward drive machine serves to apply the pulling forces. In addition the rotary drive 7 is used to transmit a rotary movement to the drilling head 6. The sensor 4 for positional determination is still arranged at the end of the outer string 3 formed by the directional drill string, near the enlargement drilling head 6. Introduced into the outer string 3 is an inner drill string 8 by which on the one hand the rotary forces are transmitted to the drilling head 6 and on the other hand a drive medium 9 (see FIG. 4) is passed to the drilling head 6. The drive medium 9 is usually compressed air but can also comprise other suitable media which are capable of flow.

Connected to the free end of the drawn drilling head 6 is a support pipe 10 which is drawn into the borehole produced, during production of the enlargement bore with the drilling head 6. In that case to produce the enlargement bore a support medium 11 (see FIGS. 3 and 4) is introduced into the support pipe 10. For that reason, in production of the enlargement bore, the pump and mixing unit 5 for the support medium 11 is arranged near the location at which the support pipe 10 issues from the borehole.

Figure 3:
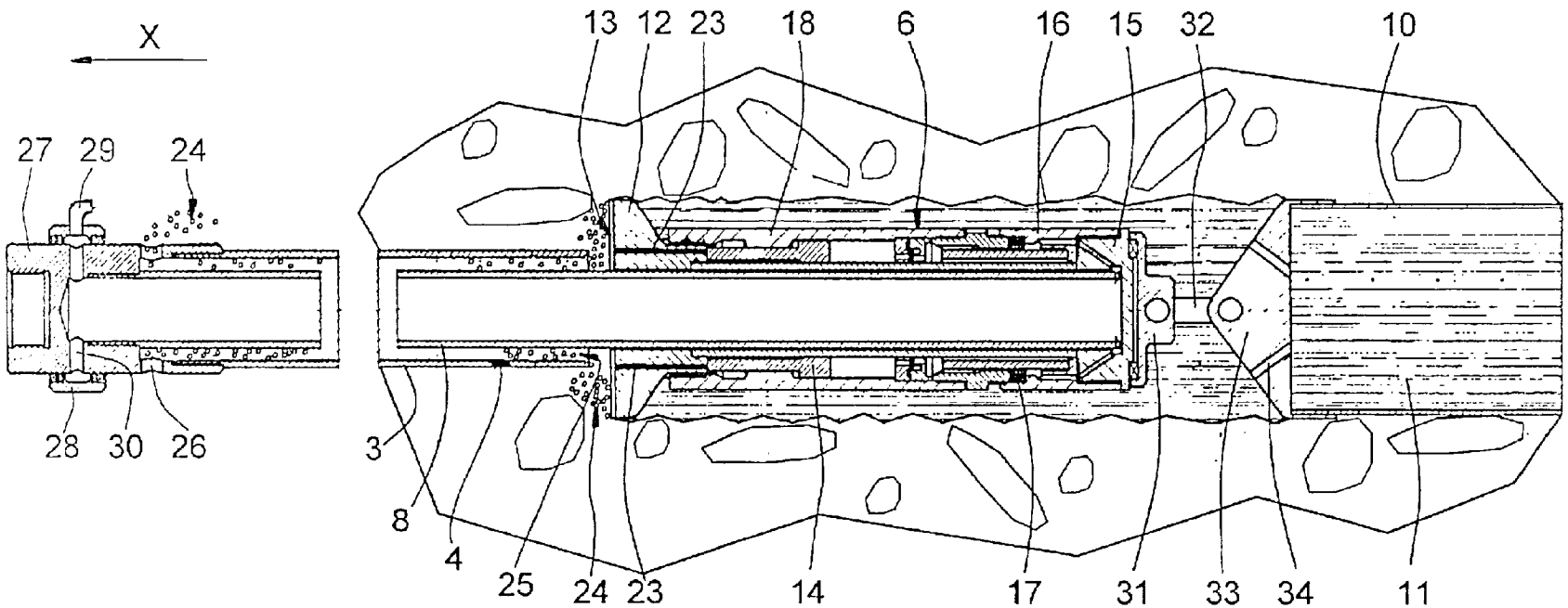
FIG. 3 is a view on an enlarged scale in section of the drilling head according to the invention in the borehole.
Figure 5:
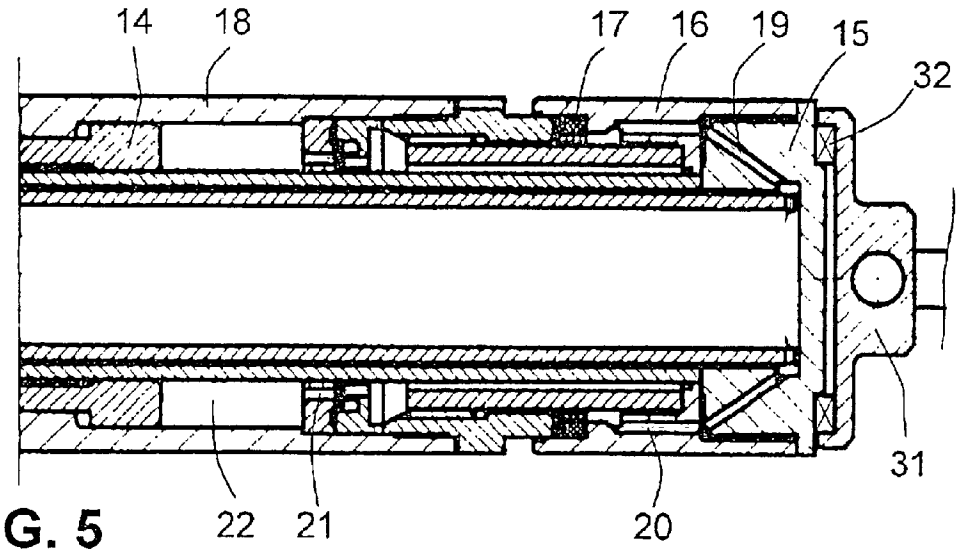
FIG. 5 is a view on an enlarged scale of the end, which is the rear end in the pulling direction, of the drilling head shown in FIGS. 3 and 4.

FIG. 3 is a view on an enlarged scale showing the drilling head 6 disposed in the borehole. The drilling head 6 includes a drilling bit 12 at its end which is towards the drill string 8. As the drilling head 6 with the drilling bit 12 is drawn by means of the drill string 8 through the borehole in a direction X indicated by an arrow, the free end face of the drilling bit 12, which faces in the pulling direction X, is the annular drilling arrangement 13 which causes the removal of material in the bottom of the borehole.

A drive medium 9 is passed through the inner drill string 8 which projects through the drilling head 6 as far as its rear end. The drive medium 9 drives a percussion piston 14 which applies hammer blows to the rear of the drilling bit 12, which is opposite the annular drilling arrangement 13. Screwed to the end of the drill string 8 is a closure cover 15 which closes the drill string 8 and transmits the pulling forces to the annular drilling arrangement 13. Screwed on to the closure cover 15 on the outside is a connecting sleeve 16 which, at its end which is the front end in the pulling direction X, carries an elastic damping element 17. The annular drilling arrangement 13 is supported against that damping element 17 by way of an intermediate portion 18. The annular drilling arrangement 12 itself is held displaceably by a certain distance in the axial direction with respect to the drill string 8 and preferably also the intermediate portion 18. In that way the hammer blows of the percussion piston 14 which is arranged within the intermediate portion 18 of the drilling head and which surrounds the drill string 8 are applied exclusively to the annular drilling arrangement 13 and not the drill string 8.

Provided for driving the percussion piston 14 in the closure cover 15 are flow passages 19 which permit the drive medium 9 to pass through further flow passages 20, 21 of the drilling head 6 into the annular space 22 in which the percussion piston 14 is guided. Pneumatic control of the percussion piston 14 of an Imloch hammer is well known to the man skilled in the art and is not described in greater detail here.

The drive medium 9 used for driving the percussion piston 14 flows through a plurality of flow passages 23 in the drilling bit 12 to the face thereof which is the front face in the pulling direction X and which forms the annular drilling arrangement 13. The drive medium 9 is at an increased pressure in relation to the atmosphere so that it passes from the region in front of the annular drilling arrangement 13 jointly with the drilling waste material 24 into an annular entry opening 25 which is arranged between the inner drill string 8 and the outer string 3 at a spacing relative to the annular drilling arrangement 13. The drive medium 9 jointly with the drilling waste material 24 can then flow through the annular space between the drill string 8 and the outer string 3 until it issues through exit openings 26 at the end of the outer string 3, outside the borehole.

The exit openings 26 are disposed at a common coupling element 27 which carries both the inner drill string 8 and also the outer string 3. A feed conduit 29 for the drive medium 9 is connected to the coupling element 27 by way of a ring seal 28. Entry passages 30 which open into the ring seal 28 permit the drive medium to flow into the interior of the inner drill string 8.

Figure 2:
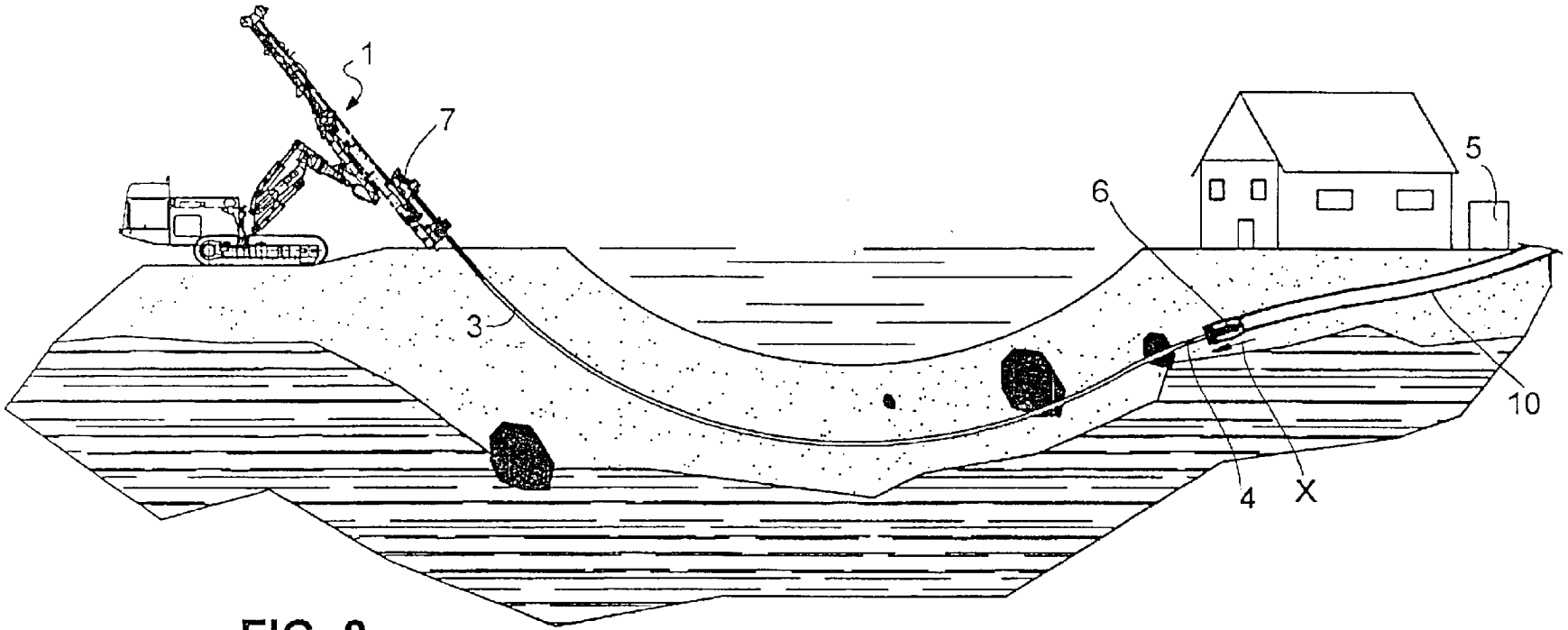
FIG. 2 is a diagrammatic view corresponding to FIG. 1 of an apparatus for carrying out enlargement drilling with a drilling head according to the invention.

The coupling element 27 is connected to the rotary drive 7 and the linear drive of the forward drive machine 1 (see FIG. 2) and transmits the pulling and rotary forces to the inner drill string 8 and the outer string 3.

It can thus be seen that the configuration of the drilling apparatus according to one embodiment of the invention permits the drive medium to be transported away out of the borehole through the double-wall string without requiring a discharge flow outside the drill string through the borehole itself. That is very important in particular in the case of the described directional drilling procedure as—as described hereinafter—the walls of the bore are supported by way of a support medium which is not to be blown out by the drive medium 9. As the passage for blowing out the drive medium is embodied in the string of the drilling apparatus, the string can bear flush against the borehole to be enlarged. This means that the drilling head 6 does not have to be guided or centred within the borehole to be enlarged.

As mentioned, preferably the enlarged bore is lined by a support pipe 10 which is drawn jointly with the drilling head 6 through the borehole. For that reason, fixedly connected to the closure cover 15 at the end of the drill string 8 is a pulling bell member 31 which is decoupled from the rotary movement of the drilling head 6 by way of a rolling bearing 32. A head plate 33 is connected to the pulling bell member 31 by way of a pulling element 32. The support pipe 10 is fixed for example by way of a screwthread connection to the head plate 33.

The drilling mud 11 (comprising a bentonite/water mixture) is passed into the borehole through the support pipe 10. The head plate 33 has a plurality of discharge flow passages 34 for the drilling mud 11. The surface of the head plate 33, which is the front surface in the pulling direction X and which faces towards the pulling bell member 31 is conical in order to promote displacement of the drilling mud 11 in the region in front of the head plate 33 towards the wall of the borehole. That therefore affords a slightly compacted bentonite layer between the wall of the support pipe 10 and the ground, which by virtue of its gel-like consistency reduces the friction between the support pipe 10 and the ground.

LIST OF REFERENCES

1 forward drive machine
2 directional drilling head
3 directional drill string, outer string
4 magnetic probe
5 pump and mixing unit
6 drilling head
7 rotary drive
8 inner drill string
9 drive medium
10 support pipe
11 support medium
12 drilling bit
13 annular drilling arrangement
14 percussion piston
15 closure cover
16 connecting sleeve
17 damping element
18 intermediate portion
19 flow passage
20 flow passage
21 flow passage
22 annular space
23 flow passage
24 drilling waste material
25 entry opening
26 exit opening
27 coupling element
28 ring seal
29 feed conduit
30 entry passage
31 pulling bell member
32 pulling element
33 head plate
34 discharge flow passage
X pulling direction

We claim:

1. A drilling apparatus for enlarging a bore in the ground, comprising:

a linear drive;

a drilling head having a drilling bit;

a percussion piston which is driven by a drive medium and which impacts against the drilling bit; and a hollow drill string to which the drilling head is fixed and through the cavity of which the drive medium is passed to the percussion piston, characterised in that the drill string is surrounded by a hollow outer string enclosing an annular space which surrounds the drill string and through which the drive medium is passed out of the borehole; and wherein the drill string and the hollow outer string are coupled to the linear drive.

2. A drilling apparatus according to claim 1 characterised in that the drill string extends through the drilling head.

3. A drilling apparatus according to claim 1 characterised in that the percussion piston is of an annular configuration and has the drill string passing therethrough.

4. A drilling apparatus according to claim 1 characterised in that an annular drilling arrangement is arranged at the side of the drilling head, which is remote from the end of the drill string.

5. A drilling apparatus according to claim 4 characterised in that in the proximity of the annular drilling arrangement the outer string has at least one entry opening for the entry of the drive medium, jointly with the drilling waste material.

6. A drilling apparatus according to claim 1 characterised in that at least one exit opening for the drive medium is arranged in the annular drilling arrangement.

7. A drilling apparatus according to claim 1 characterised in that the annular drilling arrangement is non-rotatably connected to the drill string and that the drill string is non-rotatably connected to a rotary drive outside the borehole.

8. A drilling apparatus according to claim 1 characterised in that the annular drilling arrangement is non-rotatably connected to the outer string and that the outer string is non-rotatably connected to a rotary drive outside the borehole.

9. A drilling apparatus according to claim 1 characterised in that the drill string is connected outside the borehole to the linear drive which draws the drill string through the borehole.

10. A drilling apparatus according to claim 1 characterised in that the annular drilling arrangement is connected movably in the axial direction to the drill string by way of an elastic damping element.

11. A drilling apparatus according to claim 1 characterised in that mounted at the end of the drill string, which is in the borehole, is a connecting element to which a support pipe is fixed.

12. A drilling apparatus according to claim 11 characterised in that the support pipe is decoupled from the rotary movement of the drill string.

13. A drilling apparatus according to claim 11 characterised in that the connecting element has a head plate for closing the support pipe.

14. A drilling apparatus according to claim 13 characterised in that the head plate has at least one discharge flow passage for a support medium which is supplied through the support pipe.

15. A drilling apparatus according to claim 13 characterised in that the surface of the head plate, which faces towards the drill string, at least in the outer region of the periphery thereof, extends inclinedly relative to the radial direction of the drill string.

16. A method of enlarging an existing borehole, in which a drilling head is fixed to a hollow drill string introduced into the borehole and is drawn through the borehole, wherein a percussion piston impacts on a drilling bit of the drilling head during the drilling operation, the percussion piston being driven by a drive medium which is fed through the hollow drill string, characterised in that an outer string surrounding the drill string is drawn jointly therewith through the borehole, wherein an annular space is enclosed between the outer string and the drill string, and that the drive medium is passed through that annular space out of the borehole.

17. A method according to claim 16 characterised in that the outer string is introduced into the borehole in such a way that it bears flush against the wall of the borehole.

18. A method according to claim 17 characterised in that a steerable directional drilling head is fixed to the end of the outer string for introducing the outer string into the borehole.

19. A method according to claim 17 characterised in that when introducing the outer string a support medium is introduced into the borehole produced by the directional drilling head, forming a borehole wall bearing flush against the outer string.

20. A method according to claim 17 characterised in that during drilling with the directional drilling head a percussion string extending within the outer string transmits hammer blows to the directional drilling head and that the percussion string is driven out of the outer string prior to the introduction of the inner drill string.

21. A method according to claim 16 characterised in that fixed to the side of the drilling head, that is opposite to the drill string, is a support pipe which is drawn jointly with the drilling head through the enlarged borehole.

22. A method according to claim 21 characterised in that a support medium is introduced into the borehole through the support pipe, the support medium issuing at the end of the support pipe near the drilling head.

23. A method according to claim 21 characterised in that the drilling head is caused to rotate by a rotary drive by way of at least one of the strings.

24. A method according to claim 23 characterised in that the support pipe is decoupled from the rotary movement of the string.

25. A drilling apparatus for enlarging a bore in the ground, comprising:

a drilling head having a drilling bit;

a percussion piston which is driven by a drive medium and which impacts against the drilling bit; and a hollow drill string to which the drilling head is fixed and through the cavity of which the drive medium is passed to the percussion piston, wherein the drill string is surrounded by a single wall hollow outer string enclosing an annular space which surrounds the drill string and through which the drive medium is passed out of the borehole.

26. A drilling apparatus according to claim 25 characterised in that the drill string extends through the drilling head.

27. A drilling apparatus according to claim 25 characterised in that the percussion piston is of an annular configuration and has the drill string passing therethrough.

28. A drilling apparatus according to claim 25 characterised in that an annular drilling arrangement is arranged at the side of the drilling head, which is remote from the end of the drill string.

29. A drilling apparatus according to claim 28 characterised in that in the proximity of the annular drilling arrangement the outer string has at least one entry opening for the entry of the drive medium, jointly with the drilling waste material.

30. A drilling apparatus according to claim 25 characterised in that at least one exit opening for the drive medium is arranged in the annular drilling arrangement.

31. A drilling apparatus according to claim 25 characterised in that the annular drilling arrangement is non-rotatably connected to the drill string and that the drill string is non-rotatably connected to a rotary drive outside the borehole.

32. A drilling apparatus according to claim 25 characterised in that the annular drilling arrangement is non-rotatably connected to the outer string and that the outer string is non-rotatably connected to a rotary drive outside the borehole.

33. A drilling apparatus according to claim 25 characterised in that the drill string is connected outside the borehole to a linear drive which draws the drill string through the borehole.

34. A drilling apparatus according to claim 25 characterised in that the annular drilling arrangement is connected movably in the axial direction to the drill string by way of an elastic damping element.

35. A drilling apparatus according to claim 25 characterised in that mounted at the end of the drill string, which is in the borehole, is a connecting element to which a support pipe is fixed.

36. A drilling apparatus according to claim 35 characterised in that the support pipe is decoupled from the rotary movement of the drill string.

37. A drilling apparatus according to claim 35 characterised in that the connecting element has a bead plate for closing the support pipe.

38. A drilling apparatus according to claim 37 characterised in that the head plate has at least one discharge flow passage for a support medium which is supplied through the support pipe.

39. A drilling apparatus according to claim 37 characterised in that the surface of the head plate, which faces towards the drill string, at least in the outer region of the periphery thereof, extends inclinedly relative to the radial direction of the drill string.

40. A drilling apparatus for enlarging a bore in the ground, comprising:

a drilling head having a drilling bit;

a percussion piston which is driven by a drive medium and which impacts against the drilling bit; and a hollow drill string to which the drilling head is fixed and through the cavity of which the drive medium is passed to the percussion piston;

wherein the drill string is surrounded by a hollow outer string enclosing an annular space which surrounds the drill string and through which the drive medium is passed out of the borehole;

wherein a connecting element, to which a support pipe is fixed, is mounted at the end of the drill string;

wherein the connecting element has a head plate for closing the support pipe; and wherein the head plate has at least one discharge flow passage for a support medium which is supplied through the support pipe.

41. A drilling apparatus for enlarging a bore in the ground, comprising:

a linear drive;

a drilling head having a drilling bit;

a percussion piston which is driven by a drive medium and which impacts against the drilling bit; and a hollow drill string to which the drilling head is fixed and through the cavity of which the drive medium is passed to the percussion piston, characterised in that the drill string is surrounded by a hollow outer string enclosing an annular space which surrounds the drill string and through which the drive medium is passed out of the borehole; and wherein the drill string and the hollow outer string are connected to the linear drive.

42. A drilling apparatus according to claim 41 characterised in that the drill string extends through the drilling head.

43. A drilling apparatus according to claim 41 characterised in that the percussion piston is of an annular configuration and has the drill string passing therethrough.

44. A drilling apparatus according to claim 41 characterised in that an annular drilling arrangement is arranged at the side of the drilling head, which is remote from the end of the drill string.

45. A drilling apparatus according to claim 41 characterised in that in the proximity of the annular drilling arrangement the outer string has at least one entry opening for the entry of the drive medium, jointly with the drilling waste material.

46. A drilling apparatus according to claim 41 characterised in that at least one exit opening for the drive medium is arranged in the annular drilling arrangement.

47. A drilling apparatus according to claim 41 characterised in that the annular drilling arrangement is non-rotatably connected to the drill string and that the drill string is non-rotatably connected to a rotary drive outside the borehole.

48. A drilling apparatus according to claim 41 characterised in that the annular drilling arrangement is non-rotatably connected to the outer string and that the outer string is non-rotatably connected to a rotary drive outside the borehole.

49. A drilling apparatus according to claim 41 characterised in that the drill string is connected outside the borehole to the linear drive which draws the drill string through the borehole.

50. A drilling apparatus according to claim 41 characterised in that the annular drilling arrangement is connected movably in the axial direction to the drill string by way of an elastic damping element.

51. A drilling apparatus according to claim 41 characterised in that mounted at the end of the drill string, which is in the borehole, is a connecting element to which a support pipe is fixed.

52. A drilling apparatus according to claim 51 characterised in that the support pipe is decoupled from the rotary movement of the drill string.

53. A drilling apparatus according to claim 51 characterised in that the connecting element has a head plate for closing the support pipe.

54. A drilling apparatus according to claim 53 characterised in that the head plate has at least one discharge flow passage for a support medium which is supplied through the support pipe.

55. A drilling apparatus according to claim 53 characterised in that the surface of the head plate, which faces towards the drill string, at least in the outer region of the periphery thereof, extends inclinedly relative to the radial direction of the drill string.

* * * * *

UNITED STATES PATENT AND TRADEMARK OFFICE

CERTIFICATE OF CORRECTION

PATENT NO. : 6,808,030 B2
DATED : October 26, 2004
INVENTOR(S) : Gunter W. Klemm It is certified that error appears in the above-identified patent and that said Letters Patent is hereby corrected as shown below:

Column 11,
Line 27, please delete “bead” and substitute -- head --.

Column 12,
Line 19, please delete “according to claim 41” and substitute -- according to claim 44 --.

Signed and Sealed this

First Day of February, 2005

JON W. DUDAS
*Director of the United States Patent and Trademark Office*